US007032797B2

(12) United States Patent
Liao

(10) Patent No.: US 7,032,797 B2
(45) Date of Patent: Apr. 25, 2006

(54) PUNCHING-DEPTH ADJUSTING DEVICE FOR USE WITH A NAILING GUN

(75) Inventor: Walter Liao, Tali (TW)

(73) Assignee: Falcon Pneumatic Inc., Tali (TW)

( * ) Notice: Subject to any disclaimer, the term of this patent is extended or adjusted under 35 U.S.C. 154(b) by 0 days.

(21) Appl. No.: 10/929,410

(22) Filed: Aug. 31, 2004

(65) Prior Publication Data

US 2006/0043145 A1 Mar. 2, 2006

(51) Int. Cl.
*B25C 1/04* (2006.01)

(52) U.S. Cl. ..... 227/142

(58) Field of Classification Search ..... 227/142, 227/147, 130, 119

See application file for complete search history.

(56) References Cited

U.S. PATENT DOCUMENTS 4,637,539 A * 1/1987 Turcott et al. ..... 227/156
5,074,453 A * 12/1991 Tachihara et al. ..... 227/130
6,145,723 A * 11/2000 Gupta ..... 227/8
6,427,896 B1 * 8/2002 Ho et al. ..... 227/142
6,557,745 B1 * 5/2003 Wang ..... 227/142
6,598,775 B1 * 7/2003 Chen ..... 227/113
6,705,501 B1 * 3/2004 Miller et al. ..... 227/8
6,851,595 B1 * 2/2005 Lee ..... 227/142
6,932,261 B1 * 8/2005 Huang ..... 227/120

* cited by examiner

*Primary Examiner*—Scott A. Smith
(74) *Attorney, Agent, or Firm*—Fei-Fei Chao; Bingham McCutchen LLP

(57) ABSTRACT

A punching-depth adjusting device for use with a nailing gun is adapted to cooperate with the conventional connecting device and has a scale sleeve (16), a sleeve (14), and a resilient C-ring (12). The scale sleeve (16) has an outer periphery and multiple cutouts (162) partially defined around the outer periphery. The sleeve (14) movably sleeves around the scale sleeve (16) and has a through hole (144) defined through the sleeve (14). The resilient C-ring (12) clips on the sleeve (14) and selectively engages with the scale sleeve (16) via the through hole (144). Thereby, the sleeve (14) is enabled to be located at different axial positions to arrange for a predetermined length of a nail to protrude from a workpiece.

4 Claims, 8 Drawing Sheets

PUNCHING-DEPTH ADJUSTING DEVICE FOR USE WITH A NAILING GUN

BACKGROUND OF THE INVENTION

1. Field of the Invention

The present invention relates to an adjusting device for use with a nailing gun, and more particularly to an adjusting device mounted on a nailing gun so that the nailing gun can be easily adjusted in its punching depth.

2. Description of Related Art

With reference to FIGS. 7 and 8, a conventional pneumatic nailing gun comprises a head (50) with a front and a bottom, a compressed air source connector (51) formed on the bottom of the head (50), and a threaded port (52) with a piston shaft (522) mounted on the front of the head (50). Additionally, a connecting device (60) is detachably mounted on the threaded port (52).

The connecting device (60) has a stationary tube (65) engaging with the threaded port (52) and accommodating a bush (61), a washer (62), a spring (63) and a movable socket (64) in a sequence from the inside to the outside around the piston shaft (522). Wherein, the movable socket (64) is pushed outward by the spring (63) but limited by the stationary tube (65). Thereby, the movable socket (64) is retractable when abutting a work face.

With particular reference to FIG. 8, when the pneumatic gun operates, a nail (not shown) is clamped between the connecting device (60) and the work face by abutting a nail head against the piston shaft (522). Then, the nailing gun is actuated to drive the piston shaft (522) to punch the nail. When the movable socket (64) contacts the work face, the movable socket (64) compresses the spring (63) to allow the movable socket (64) to be retracted inside the stationary tube (65) until the nail is completely embedded in the work face. Therefore, the conventional pneumatic gun can not reserve a section of the nail to protrude from the work face.

The present invention has arisen to mitigate or obviate the disadvantages of the conventional pneumatic nailing gun.

SUMMARY OF THE INVENTION

The objective of the present invention is to provide an adjusting device that allows a pre-determined section of the nail to protrude from a work surface when a conventional pneumatic nailing gun operates.

Further benefits and advantages of the present invention will become apparent after a careful reading of the detailed description with appropriate reference to the accompanying drawings.

DETAILED DESCRIPTION OF THE PREFERRED EMBODIMENT

A punching-depth adjusting device for use with a nailing gun in accordance with the present invention is adapted to cooperate with the conventional connecting device having a piston shaft and comprises a sleeve and a means for maintaining said sleeve on the connecting device. Wherein, the sleeve is received by the connecting device and moves relative to the connecting device between a first position and a second position along an axis of the connecting device. The means selectively keeps the sleeve at an either of the first position or the second position along the axis while the punching-depth adjusting device is in operation.

Optionally, the punching-depth adjusting device is applied to a different tool including a port having a connecting device displaceable along a tool axis common with a piston shaft. The punching-depth adjusting device still has the same configuration described above and is mounted on the connecting device.

Preferably, the punching-depth adjusting device is mounted on a nailing gun and comprises a scale sleeve, a sleeve, and a resilient C-ring. The scale sleeve has an outer periphery and multiple cutouts partially defined around the outer periphery. The sleeve movably sleeves around the scale sleeve and has a through hole defined through the sleeve. The resilient C-ring clips on the sleeve and selectively engages with the scale sleeve via the through hole. Thereby, the sleeve is enabled to be located at different axial places to reserve a desired length of a nail.

Figure 1:
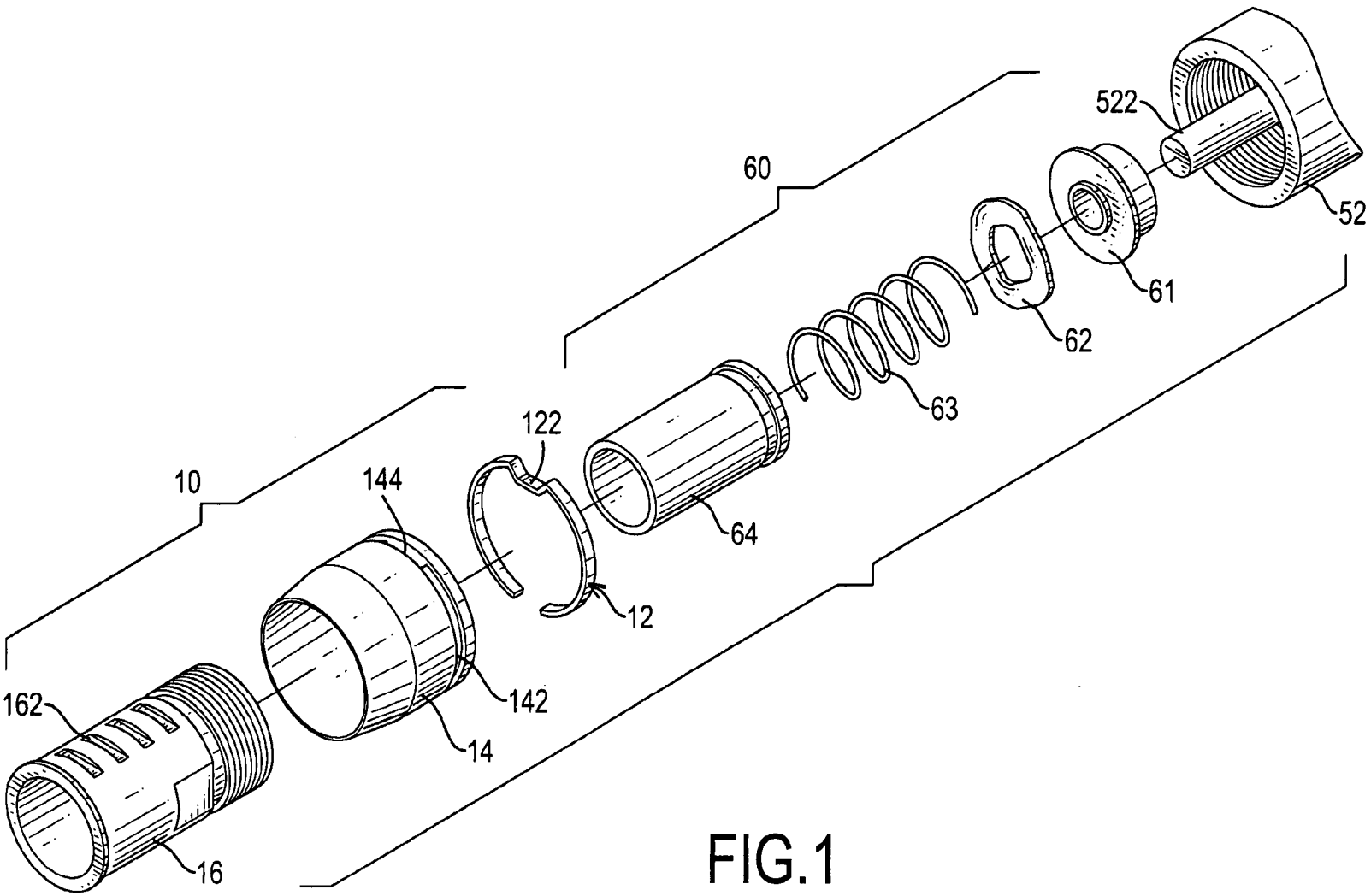
FIG. 1 is an exploded perspective view of a punching-depth adjusting device for use with a nailing gun in accordance with the present invention, wherein the punching-depth adjusting device is mounted on a pneumatic gun.
Figure 2:
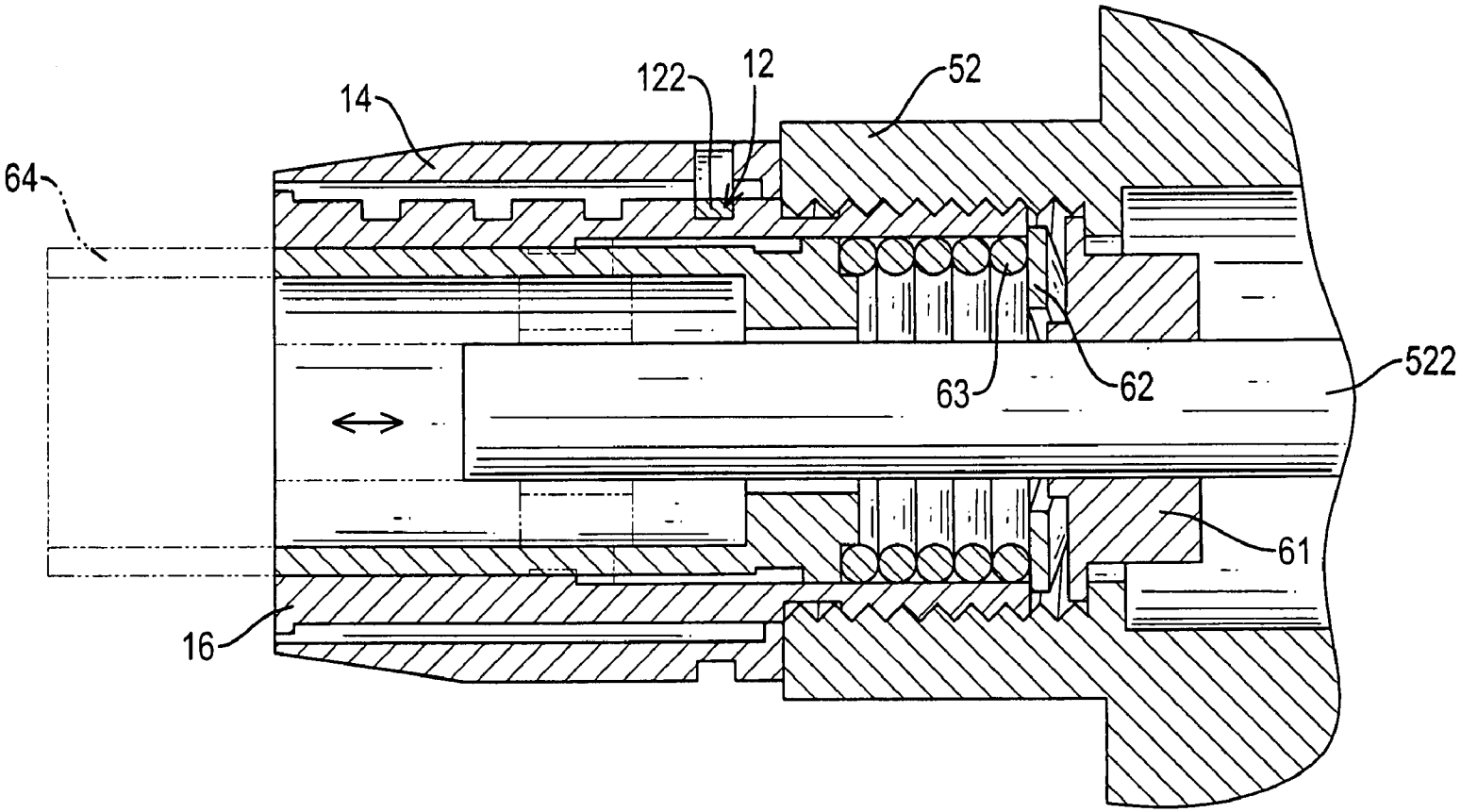
FIG. 2 is an operationally cross-sectional side view of the punching-depth adjusting device in FIG. 1, which shows movements of a movable socket.

With reference to FIGS. 1 and 2, a preferred embodiment of the punching-depth adjusting device for a nailing gun in accordance with the present invention comprises a scale sleeve (16), a sleeve (14), and a resilient C-ring (12).

The scale sleeve (16) is to substitute the stationary tube (65) in the conventional connecting device (60) to screw with the threaded port (52). The scale sleeve (16) accommodates a bush (61), a washer (62), a spring (63) and a movable socket (64) in a sequence from inside out around the piston shaft (522). Wherein, the movable socket (64) is pushed outward by the spring (63) but limited by the scale sleeve (16). Thereby, the movable socket (64) is retractable when abutting a work face. The difference of the scale sleeve (16) in the present invention and the stationary tube (65) is that multiple cutouts (162) are partially and transversely defined in the scale sleeve (16) in different positions along the axial direction.

The sleeve (14) movably mounts around the scale sleeve (16) and has an outer periphery, an optional annular groove (142), and a rectangular through hole (144). The optional annular groove (142) with a bottom is defined around the outer periphery of the scale sleeve (16). The rectangular through hole (144) is transversely defined in the bottom of the annular groove (142) to selectively align with one of the multiple cutouts (162).

The resilient C-ring (12) clips on the sleeve (14) inside the annular groove (142) and has inward portion (122) extending into the rectangular through hole (144) to selectively engage with the corresponding cutout (162) to abut the outer periphery of the scale sleeve (16).

Figure 3:
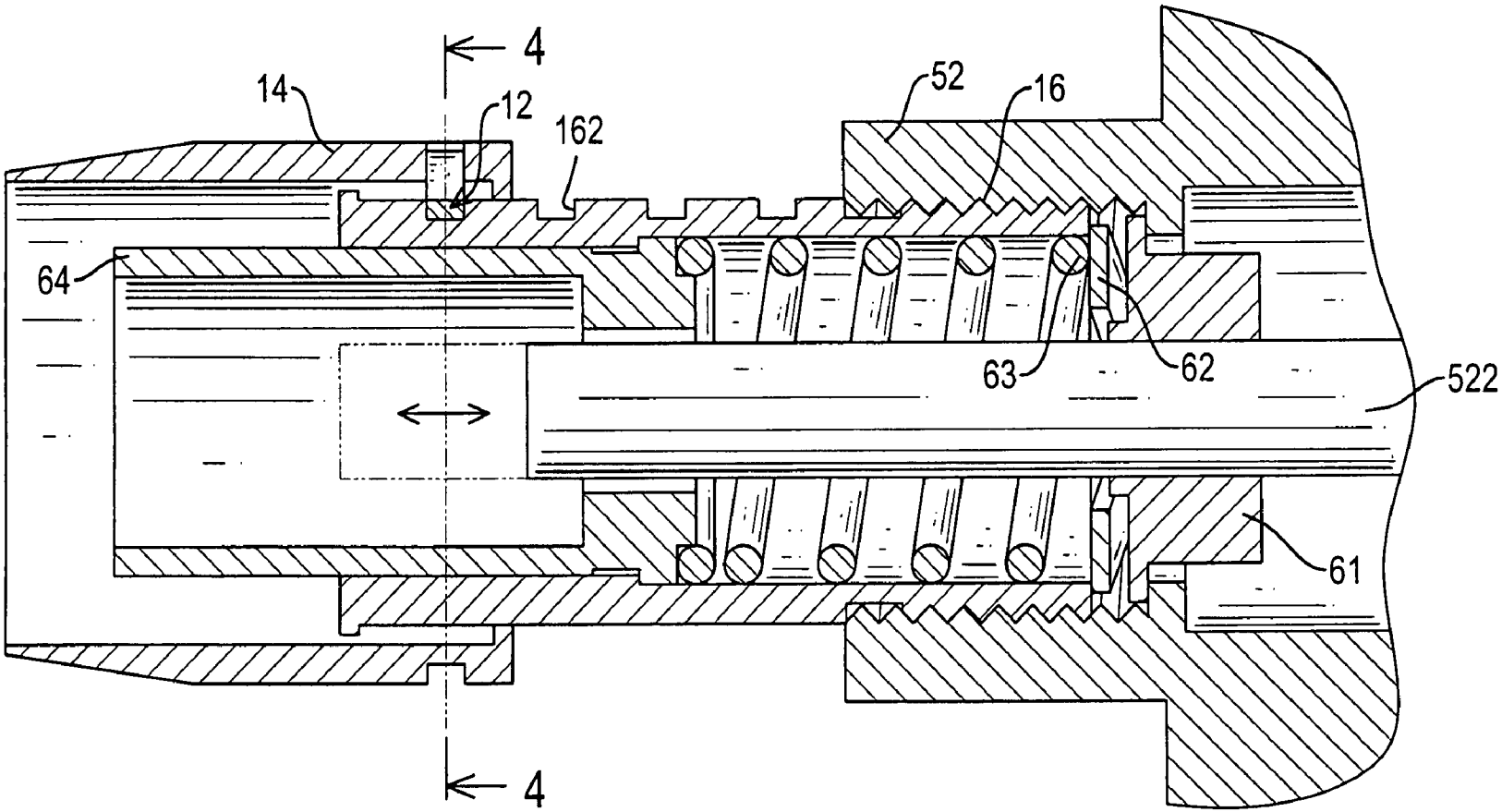
FIG. 3 is an operationally cross-sectional side view of the punching-depth adjusting device in FIG. 1, which shows movements of the sleeve.
Figure 4:
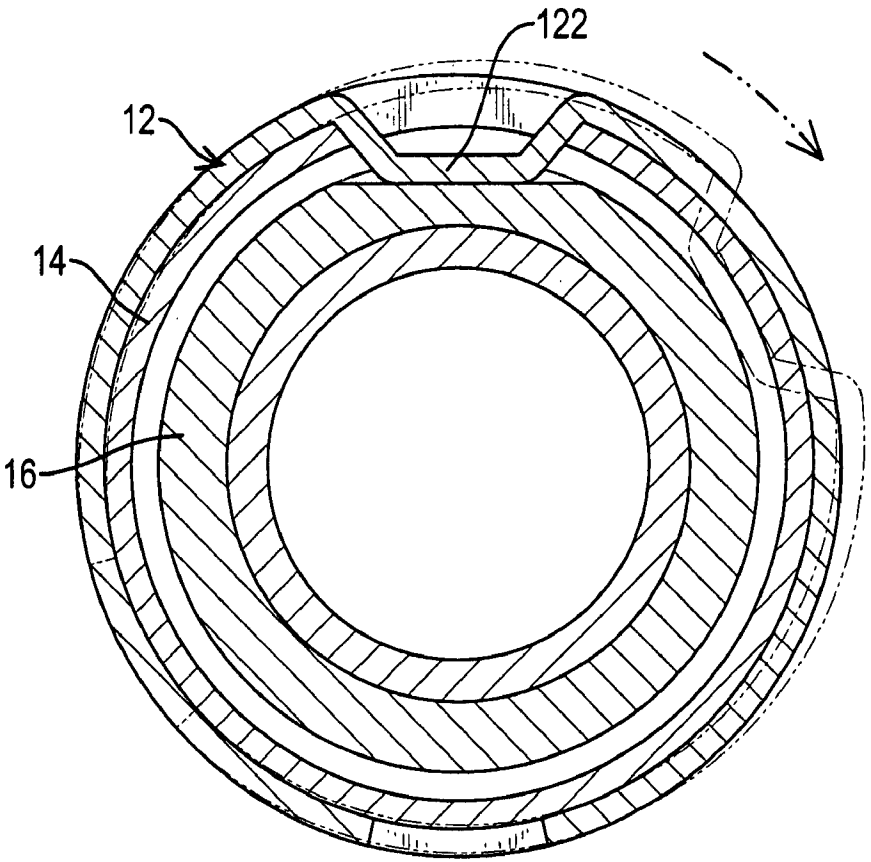
FIG. 4 is an operationally cross-sectional end view of the punching-depth adjusting device in FIG. 3, which shows rotations of the sleeve.

With reference to FIGS. 2 to 4, when the inward portion (122) engages with and is limited by the innermost cutout (162), the sleeve (14) is locked and unable to freely move along the axial direction. Meanwhile, the sleeve (14) and the scale sleeve (16) are flush with each other at distal ends and the movable socket (64) partially emerges out of the scale sleeve (16). Therefore, the nail can be completely punched into the work face as described in the conventional connecting device (60).

With particular reference to FIG. 4, when the nail is desired to have a protruding section, the sleeve (14) is rotated to make the inward portion (122) of the resilient C-ring (12) to disengage from the cutout (162). Then, the sleeve (14) is free to move along with the axial direction to make the inward portion (122) align with another cutout (162). Lastly, the sleeve (14) is rotated back to make the inward portion (122) to engage with the corresponding outer cutout (162) again.

With particular reference to FIG. 3, when the resilient C-ring (12) engages with the outermost cutout (162) on the scale sleeve (16), the sleeve (14) exceeds the scale sleeve (16). Therefore, limitation position is no longer the distal end of the scale sleeve (16) but the distal end of the sleeve (14) when punching the nail into the work surface. Thereby, a predetermined section of the nail can protrude from the work piece when the pneumatic gun is in use.

Figure 5:
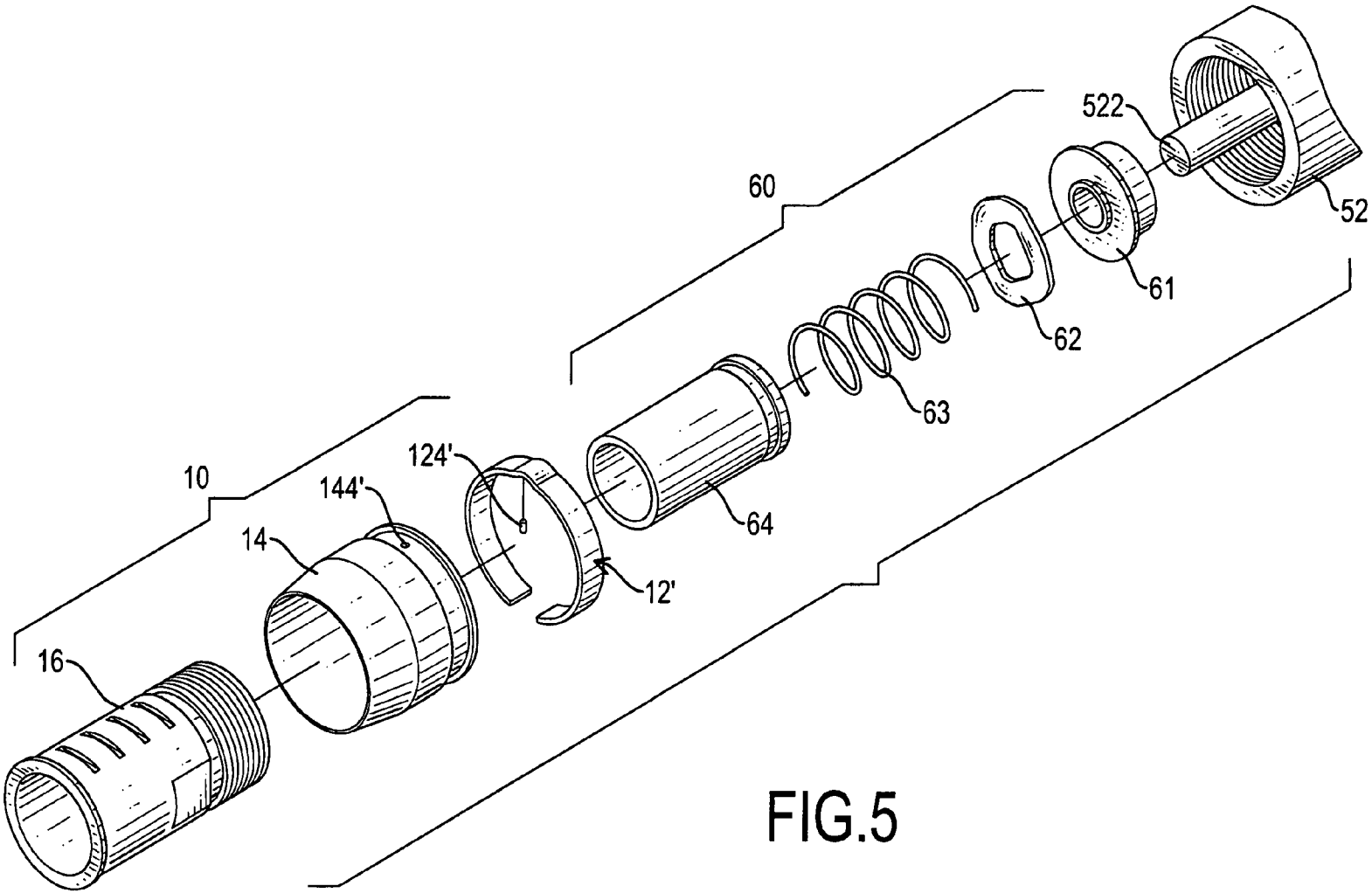
FIG. 5 is an exploded perspective view of another embodiment of a punching-depth adjusting device for a nailing gun in accordance with the present invention.
Figure 6:
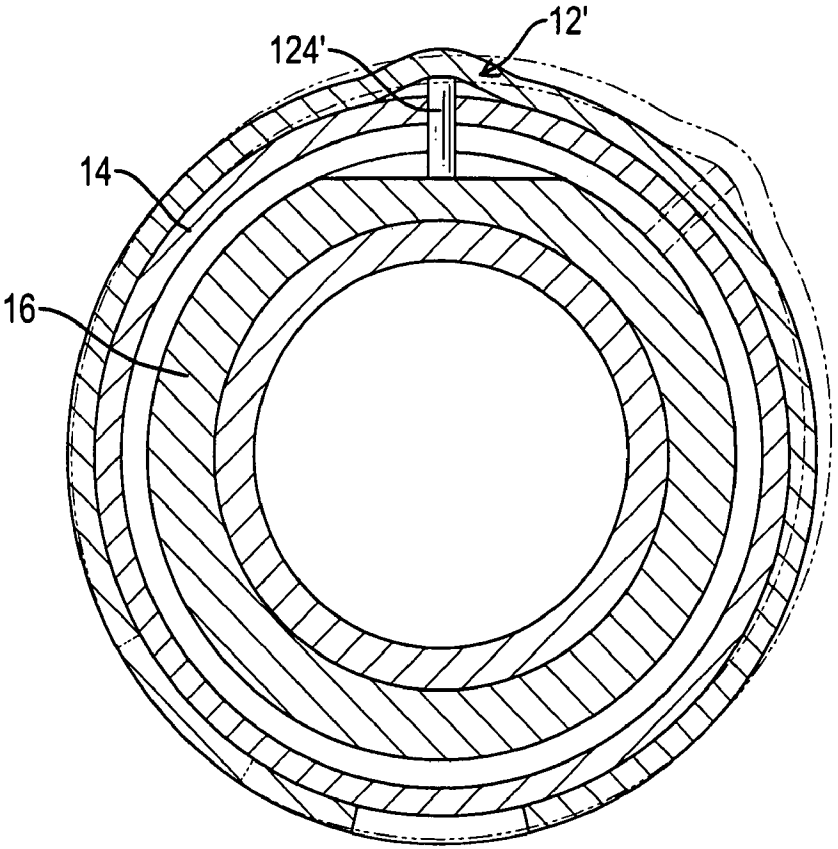
FIG. 6 is an operationally cross-sectional end view of the punching-depth adjusting device in FIG. 5, which shows rotations of the sleeve.
Figure 7:
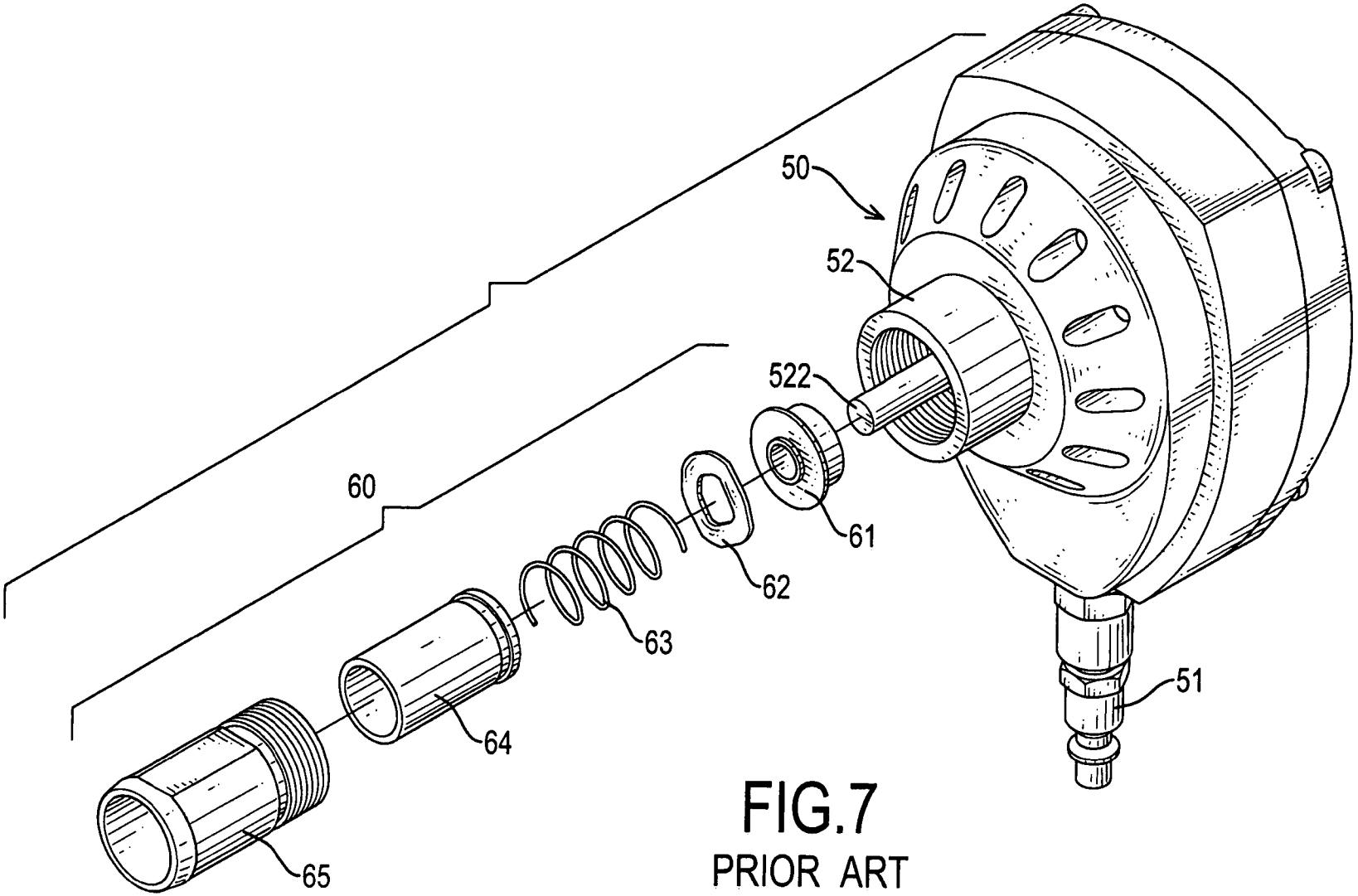
FIG.7 PRIOR ART
FIG. 7 is an exploded perspective view of a pneumatic gun with a conventional connecting device.
Figure 8:
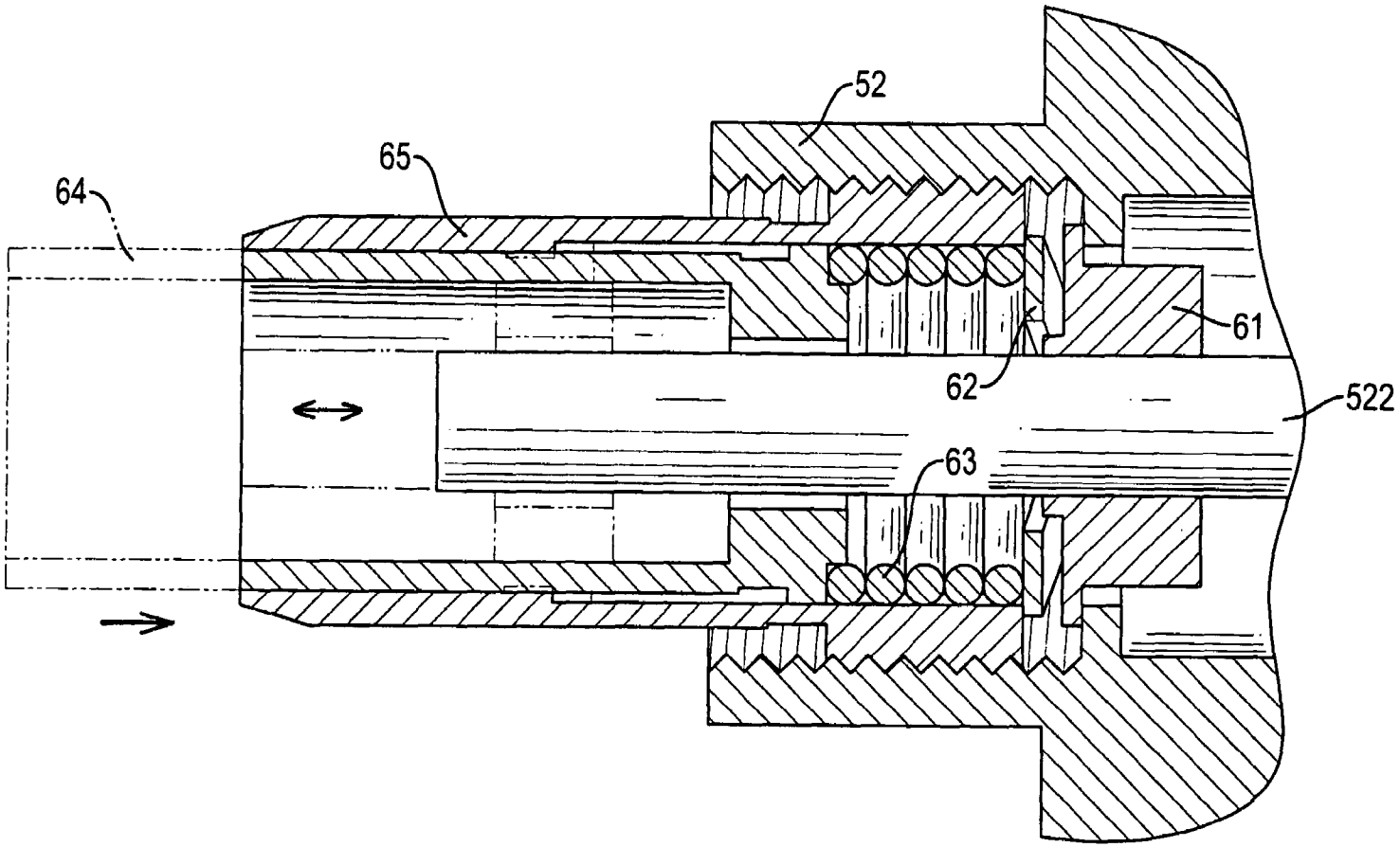
FIG.8 PRIOR ART
FIG. 8 is an operationally cross-sectional side view of the conventional connecting device in FIG. 7, which shows movements of a movable socket.

With reference to FIGS. 5 and 6, another embodiment of the punching-depth adjusting device for a nailing gun in accordance with the present invention has the same structure with the prior one except the resilient C-ring (12'). The resilient C-ring (12') is modified to have an outward dent (126') and has a positioning element (124') attached under the outward dent (126') to movably insert into the through hole (144'). The positioning element (124') is pushed inward by the resilient C-ring (12') and selectively engages with the cutouts (164) on the scale sleeve (16). Preferably, the positioning element (124') is a pin and the through hole (144') is a round hole corresponding to the pin.

With reference to FIG. 6, the positioning element (124') also engages or disengages with one corresponding cutout (162) by rotating the sleeve (14). Then, the sleeve (14) slides on the scale sleeve (16) along the axial direction to move to different cutouts (162).

The punching-depth adjusting device for use with a nailing gun as described has the following advantages.

1. The punching-depth adjusting device of the present invention can be applied to the conventional pneumatic gun conveniently without any other modification.

2. Different punching-depths can be adjusted when the resilient C-ring (12) engages with different cutouts (162) by conveniently sliding and rotating the sleeve (14) around the scale sleeve (16).

Although the invention has been explained in relation to its preferred embodiments, many other possible modifications and variations can be made without departing from the spirit and scope of the invention as hereinafter claimed.

What is claimed is:

1. A punching-depth adjusting device for use with a nailing gun, the nailing gun including a port having a socket assembly displaceable along an axis common with a piston shaft, the punching-depth adjusting device comprising:

a scale sleeve (16) having an outer periphery and multiple cutouts (162) defined in the outer periphery at different axial positions;

a sleeve (14) movably sleeving around the scale sleeve (16) and having an outer periphery, an annular groove (142) with a bottom defined around the outer periphery, and a through hole (144) defined in the bottom of the annular groove (142); and a resilient C-ring (12) clipping around the sleeve (14) and having an inward portion (122) penetrating the through hole (144) to selectively engage with one of the multiple cutouts (162).

2. A punching-depth adjusting device for use with a nailing gun comprising:

a scale sleeve (16) having an outer periphery and multiple cutouts (162) defined in the outer periphery at different axial positions;

a sleeve (14) movably sleeving around the scale sleeve (16) and having an outer periphery, an annular groove (142) with a bottom defined around the outer periphery, and a through hole (144') defined in the bottom of the annular groove (142);

a resilient C-ring (12) clipping around the sleeve (14); and a positioning element (124') attached under the resilient C-ring (12) and penetrating the through hole (144') to selectively engage with one of the multiple cutouts (162).

3. The punching-depth adjusting device as claimed in claim 2, wherein the positioning element (124') is a pin and the through hole (144) is a round hole to correspond to the pin.

4. A punching-depth adjusting device for use with a tool including a port having a connecting device displaceable along a tool axis common with a piston shaft, the punching-depth adjusting device comprising:

a sleeve received by the connecting device, the sleeve being moveable relative to the connecting device between first and second positions along the tool axis; and a means for maintaining the sleeve at a either of the first or second sleeve positions while the tool is in operation.

* * * * *